US011910963B2

(12) United States Patent
Tramontina

(10) Patent No.: US 11,910,963 B2
(45) Date of Patent: Feb. 27, 2024

(54) DISPENSER MONITORING SYSTEM

(71) Applicant: Kimberly-Clark Worldwide, Inc., Neenah, WI (US)

(72) Inventor: Paul F. Tramontina, Harleysville, PA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 354 days.

(21) Appl. No.: 17/298,039

(22) PCT Filed: Nov. 30, 2019

(86) PCT No.: PCT/US2019/063894

§ 371 (c)(1),
(2) Date: May 28, 2021

(87) PCT Pub. No.: WO2020/113196

PCT Pub. Date: Jun. 4, 2020

(65) Prior Publication Data

US 2022/0095857 A1 Mar. 31, 2022

Related U.S. Application Data

(60) Provisional application No. 62/773,461, filed on Nov. 30, 2018.

(51) Int. Cl.

| | |
|---|---|
| ***A47K 10/36*** | (2006.01) |
| ***A47K 5/12*** | (2006.01) |
| *A47K 10/32* | (2006.01) |

(52) U.S. Cl.

CPC ..... *A47K 10/36* (2013.01); *A47K 5/1217* (2013.01); *A47K 2010/3226* (2013.01)

(58) Field of Classification Search

CPC ..... A47K 10/36; A47K 2010/3226; A47K 5/1217

See application file for complete search history.

(56) References Cited

U.S. PATENT DOCUMENTS

| | | | |
|---|---|---|---|
| 7,044,421 B1 | 5/2006 | Omdoll et al. | |
| 7,774,096 B2 * | 8/2010 | Goerg | A47K 10/3662 700/244 |

(Continued)

FOREIGN PATENT DOCUMENTS

| | | |
|---|---|---|
| CN | 1901829 A | 1/2007 |
| CN | 104144752 A | 11/2014 |

(Continued)

*Primary Examiner* — Michael Collins

(57) ABSTRACT

A dispensing system for dispensing consumable product comprising a dispenser including a body comprising a front side and aback side, and a product holding area defined by the front side and the back side, wherein the product storage area is configured to store the consumable product within the dispenser; a dispensing mechanism operatively coupled to the consumable product through a consumable product holder in the product storage area, and wherein the dispensing mechanism is configured to facilitate a dispensing cycle to dispense a portion of the consumable product; a first impact sensor configured to sense a first impact to the dispenser; a dispenser event sensor configured to sense an operational status of the dispenser; and a data processing device configured to store impact data describing the first impact and operational status data describing the operational status and associate the first impact data and the operational status data.

12 Claims, 2 Drawing Sheets

(56) References Cited

U.S. PATENT DOCUMENTS

| | | | | |
|---|---|---|---|---|
| 11,241,123 | B2 * | 2/2022 | Mahaffey | A47K 5/1217 |
| 2005/0167541 | A1 | 8/2005 | Osborne | |
| 2006/0173576 | A1 * | 8/2006 | Goerg | A47K 10/3662 700/236 |
| 2009/0195385 | A1 * | 8/2009 | Huang | G16H 40/20 340/572.1 |
| 2012/0206269 | A1 * | 8/2012 | Wickman | H05B 47/115 324/679 |
| 2016/0331192 | A1 * | 11/2016 | Rubenson | A47K 10/36 |
| 2017/0051486 | A1 * | 2/2017 | Schomburg | A47K 10/18 |
| 2017/0290472 | A1 | 10/2017 | Borke et al. | |
| 2017/0290473 | A1 * | 10/2017 | Borke | A47K 10/3687 |
| 2018/0049609 | A1 | 2/2018 | Vuylsteke et al. | |
| 2018/0177348 | A1 * | 6/2018 | Swanson | A47K 10/3625 |
| 2021/0177217 | A1 * | 6/2021 | Mahaffey | A47K 5/12 |
| 2021/0232999 | A1 * | 7/2021 | Mahaffey | G06Q 10/0633 |

FOREIGN PATENT DOCUMENTS

| | | | |
|---|---|---|---|
| CN | 204374734 | U | 6/2015 |
| EP | 3135617 | A1 | 3/2017 |

* cited by examiner

DISPENSER MONITORING SYSTEM

This application claims priority from U.S. provisional Patent application Ser. No. 62/773,461 filed on 30 Nov. 2018, the entire contents of which are incorporated herein by reference.

TECHNICAL FIELD

This disclosure generally relates to dispensers for dispensing consumable products.

BACKGROUND OF THE DISCLOSURE

Systems dispensing consumable products are commonplace. For example, paper hand towel and bath tissue dispensers are in many private, semi-private and public washrooms, and sanitizer dispensers are found in many work areas, food processing stations and kitchens. From time-to-time these dispensers need to be serviced whether due to low or no product left in the dispenser or due to a malfunction or vandalism. However, servicing the dispensers can be costly and time consuming as each service requires a visit to the location of the dispenser, and the dispensers may be located in different areas of a floor, scattered across multiple floors of a building or resident in entirety different buildings. As such, it's beneficial to provide the service technicians as much information as possible about the requirements of a particular service need in advance so they can prepare accordingly and bring any necessary supplies.

Some dispensers are enabled with "smart" technology which allows, for example, the dispensers to remotely report their current product level so service technicians know when to refill the dispensers. To enable this functionality the dispensers are becoming more complex. As dispenser complexity increases a need grows to remotely diagnose and/or report dispenser anomalies to facilitate service technician service visits, which minimizes costs and decreases dispenser down time due to a malfunction or other operational issue.

SUMMARY OF THE DISCLOSURE

In general, the subject matter of this specification relates to a dispenser, e.g., a consumable product dispenser. One aspect of the subject matter described in this specification can be implemented in a dispensing system comprising a dispenser including a body comprising a front side and a back side, and a product holding area at least partially defined by the front side and the back side, wherein the product storage area is configured to store the consumable product within the dispenser; a dispensing mechanism operatively coupled to the consumable product through a consumable product holder in the product storage area, and wherein the dispensing mechanism is configured to facilitate a dispensing cycle to dispense a portion of the consumable product; a first impact sensor configured to sense a first impact to the dispenser; a dispenser event sensor configured to sense an operational status of the dispenser; and a data processing device configured to store impact data describing the first impact and operational status data describing the operational status and associate the first impact data and the operational status data. Other embodiments of this aspect include corresponding methods, apparatus, and computer program products.

Another aspect of the subject matter described in this specification can be implemented in a method that includes detecting a first impact, by a first impact sensor, to a dispenser; during a next dispense cycle of the dispenser subsequent the first impact, detecting a malfunction, by a dispenser event sensor; and in response to detecting the malfunction, sending a malfunction alert. Other embodiments of this aspect include corresponding systems, apparatus, and computer program products.

Particular embodiments of the subject matter described in this specification can be implemented so as to realize one or more of the following advantages. For example, including an impact sensor (e.g., an accelerometer) in or on a dispenser can allow monitoring and tracking of (unusual) impacts or other jarring events to or within the dispenser. For example, the impact sensor can be used to determine if the dispenser was subject to an unusual impact, as could happen from a washroom occupant stoking or running into the dispenser or a washroom service technician slamming the dispenser door closed, which, in either case, could result in damage to the dispenser. Further, for example for rolled hand towel dispensers, the impact sensor could be mounted proximate the arms supporting the roll so as to detect the vibration or impact from the roll accidentally falling off the arms, which would result in a dispenser malfunction.

This type of impact information can be used to troubleshoot dispenser issues. For example, if a low paper sensor signaled a low paper condition a technician might assume all the paper has been depleted and make a service call to the dispenser to refill it. However, if the impact sensor near the roll arms reports an impact (e.g., indicating the roll fell off the arms) just before the low paper sensor alert, it may indicate that the roll arms are malfunctioning and should be replaced, in which case the service technician will bring spare parts or a replacement dispenser on the service call. Thus the impact data can be used be used alone or in combination with other dispenser data to provide context for a dispenser malfunction or service need or the conditions under which the dispenser is operating, without a costly and time-consuming in-person service call and inspection.

The details of one or more implementations of the subject matter described in this specification are set forth in the accompanying drawings and the description below. Other features, aspects, and advantages of the subject matter will become apparent from the description, the drawings, and the claims.

Figure 1:
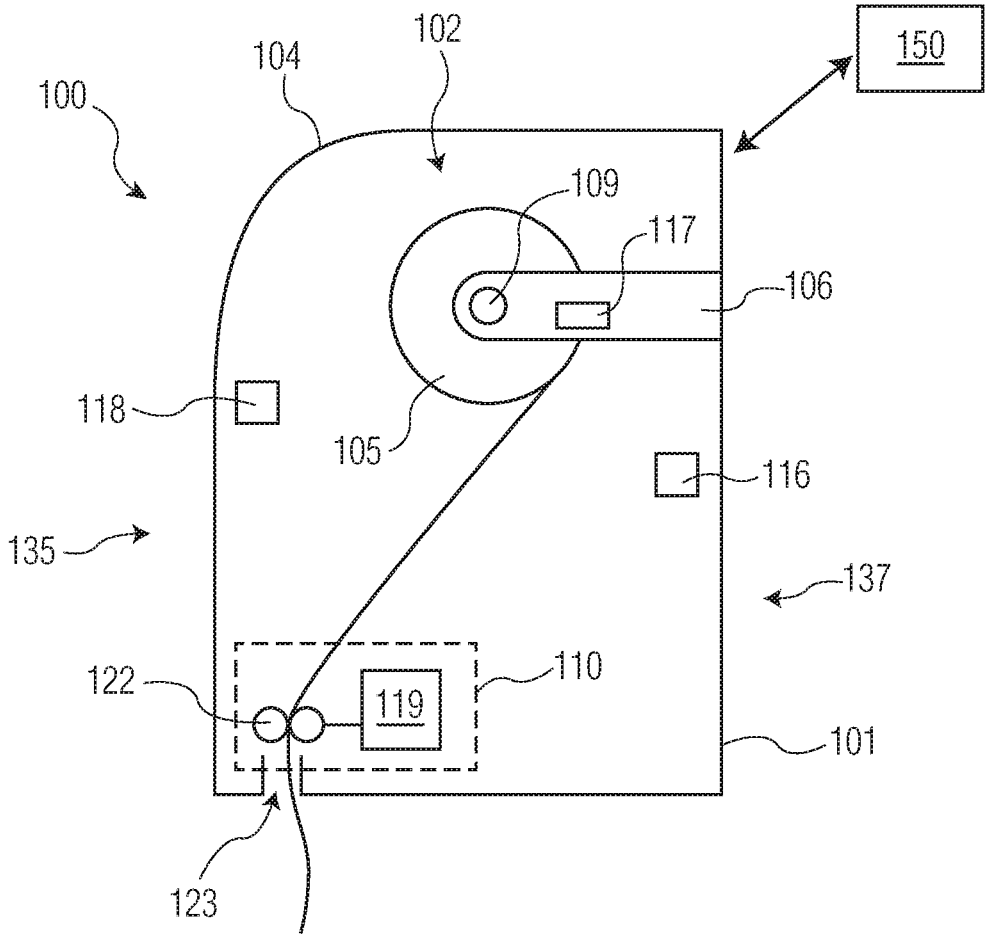
FIG. 1 is a cutaway representation of an example dispensing system.

Repeat use of reference characters in the present specification and drawings is intended to represent the same or analogous features or elements of the disclosure.

DETAILED DESCRIPTION OF THE DISCLOSURE

The present disclosure relates to determining a dispenser operational status inducting whether the dispenser was subjected to or recorded any anomalous impacts. For example, an impact (e.g. from a washroom occupant walking into the dispenser or from a service technician slamming the dispenser door closed) can knock the consumable product in the dispenser from its mount or other holding position and cause a malfunction. So detecting such impacts can assist, for example, with diagnosing and correcting a dispenser malfunction.

To this end, the dispensing system includes an impact sensor, such as an accelerometer, to sense impacts to the dispenser and/or (abnormal) movement of parts or components inside the dispenser (e.g., depending on how and where the impact sensor is mounted). The dispenser can also include an event sensor (e.g., another accelerometer, a low product sensor, a motor current sensor, etc.) that can be used to concert with the impact sensor to infer or diagnosis a malfunction and (in some instances) its cause. For example, the impact sensor and event sent may be accelerometers with the impact sensor mounted on the body of the dispenser and the event sensor mounted on the roll holder of the dispenser. In this configuration, if the event sensor detects movement/vibrations before, but close-in-time to, the impact sensor detecting movement/vibrations it could be indicative of the roll falling from the holder and the vibration from the fall traveling first hitting the event sensor and then through the body and reaching the impact sensor fractions of a second later. A service technician could use this information to investigate the roll holder as it may be faulty.

Figure 2:
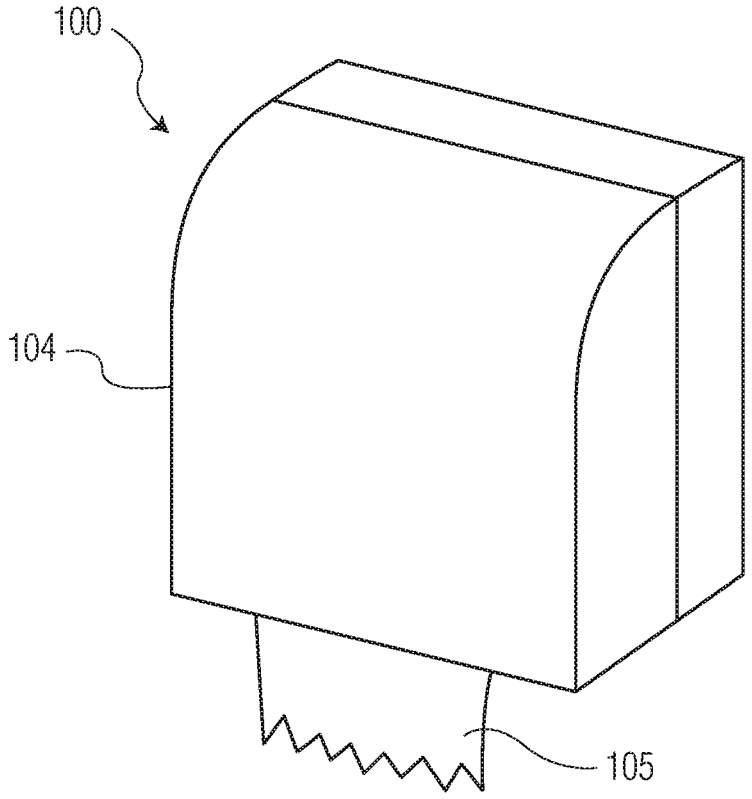
FIG. 2 is a perspective representation of the example dispensing system.

Conversely, if the event sensor detects movement/vibrations after, but close-in-time to, the impact sensor detecting movement/vibrations it could be indicative of an abnormal impact to the dispenser that causes the roll to fall from the holder, e.g., by vibrations moving from the body of the dispenser where the impact occurred to the roll holder causing the roll to dislodge. This information would allow a service technician to appreciate that it was not a failure of the roll holder that caused the malfunction but rather an anomalous impact event, e.g., a washroom occupant walking into the dispenser, which would facilitate and expedite the service call or other treatment of the dispenser. A dispensing system with this functionality is described in more detail below with reference to FIG. 1, which is a cutaway representation of an example dispensing system 100 (in this representation, a portion of the body 104, e.g., a side cover portion, of the dispenser 101 is not shown to illustrate the interior of the dispenser 101), and FIG. 2, which is a perspective representation of the example dispensing system 100.

The dispenser 101 of the dispensing system 100 can be, for example, a hand towel dispenser, bath tissue dispenser, liquid soap dispenser, wiper dispenser, sanitize dispenser, fragrance dispenser or the like. The dispenser 101, more generally, is a device that holds consumable product and dispenses the consumable product in response to a stimulus, e.g., a user or environmental stimulus, or at pre-determined (e.g., programmatically) set intervals. The dispenser 101 includes a body 104, e.g., a composite, polymeric or metal housing. The body 104 encloses, fully or partially, a product holding area 102 of the dispenser 101.

The product holding area 102 holds, for example, the consumable product 105 (e.g., paper towels (rolled and folded), bath tissue, wipes/wipers, liquid soap or sanitizer, lotion, deodorizer, etc.) in position for dispensing. In some implementations, for example, for consumable product 105 such as rolled hand towels or bath tissue, the product holding area 102 can be accessed by rotating a front side 135 of the body 104 away from a back side 137 (e.g., the wall mounted side) by a hinge or the like. In these representations, a portion of the body 104 (e.g., a side cover portion) is not shown to illustrate the interior of the dispenser 101.

The dispenser 101 also includes a dispensing mechanism 110. In general, the dispensing mechanism 110 is coupled to the consumable product 105 through a consumable product holder 106 (which in some implementations can be part of the dispensing mechanism 110) in the product holding area 102. The dispensing mechanism 110 operates to dispense a portion of the consumable product 105 (e.g., dispense a length of roll 105 for use to dry hands). In some implementations, the dispensing mechanism 110 is an electromechanical feed mechanism that includes or operates in conjunction with a motor 119 that, in response to a stimulus such as a user waving a hand proximate the dispenser 101, feeds a length of the roll 105 through an opening 123 in the body 104 to present to tee user. For example, the dispensing mechanism 110 can include a series of rollers 122 through which a portion of the roll 105 is feed such that when the dispensing mechanism 110 actuates it pulls and unwinds the roll 105 (or causes the roll 105 to be pulled and unwound) to feed a portion of the roll 105 to the user. In some implementations, the motor 119 can be integral to the roll holder 106 and causes a spindle 109 of the roll holder 106 (e.g., on which the rolled product 105 is mounted) to turn thereby causing the roll 105 to unwind and be dispensed.

In the case, for example, of a liquid soap or sanitizer dispenser 100 the motor 119 may be a pump 119 that draws the liquid product from a bottle, cassette or other container in the product storage area holding the liquid product to use for a dispense operation. In the case of folded towels, the dispenser mechanism 110 is the throat of the dispenser 101, through product is dispensed and by which pressure (e.g., friction) is exerted on the towels as they are pulled through the throat to cause one towel to separate from another to enable single towel dispensing.

In some implementations, the dispenser 101 is a user-driven dispensing unit, e.g., the dispense process is not powered by a motor 119 or other electromechanical generator. For example, for a dispenser 101 such as a paper towel, bath tissue, or folded towel dispenser, a user may grab an exposed tail of the product 105 and pull to cause more of the product 105 to be dispensed. For a liquid soap or sanitizer dispenser 101, a user may depress or otherwise manually actuate a pump (e.g., dispensing mechanism 110) to draw the product 105 from its container and dispense the product 105.

The dispenser 101 includes a first impact sensor 116. The first impact sensor 116 senses impacts (e.g., first impacts) or other physical contact events with the dispenser 101 that causes vibrations in or movement (e.g., including micro-scale movement) of the dispenser 101. In some implementations, the first impact sensor 116 is an accelerometer or a velocity sensor. For example, the first impact sensor 116 can detect impacts to the dispenser 101 ranging from when struck in acts of vandalism or equipment abuse (e.g., a washroom occupant slapping or otherwise hitting the dispenser 101 or service attendants harshly closing the dispenser door during servicing) to internal malfunctions such as a the consumable product 105 being dislodged or falling from its dispensing position (e.g., a paper towel roll 105 falling from the roll holder 106) or vibrations from a misaligned motor 119 or roller 122, as the vibrations (e.g., mechanical waves) from such even may reach a body-mounted impact sensor 116.

In some implementations the first impact sensor 116 is mounted or otherwise located on the body 104 (e.g., an internal side of the body 104). The first impact sensor 116 can store data describing impact events or it can communicate such impacts to the data processing device 118 and the data processing device 118 can store the impact data and associated time/date data describing when the impact occurred (e.g., Dec. 11, 2018 at 5:06 PM).

The dispensing system 100 also includes a dispenser event sensor 117 to sense an operational status of the dispenser 101. The operational status can be, for example, a paper or pump jam condition, a low consumable product condition or low battery condition or another abnormal or service need type condition (e.g., a sensor not responding issues). As with the first impact sensor 116, the dispenser event sensor 117 can store data describing an operational status or it can communicate such data to the data processing device 118 and the data processing device 118 can store the data and associated time/date data describing when the operational status was recorded (e.g., Dec. 11, 2018 at 5:07 PM).

In some implementations the dispenser event sensor 117 is a motor overcurrent sensor (e.g., to detect the current spike in the motor 119 during a paper or pump jam condition), an impact sensor (e.g., similar to or same as the first impact sensor 116 to detect abnormal vibrations or movement of components or product 105 in the dispenser 101), a low product or amount of product used or remaining sensor (e.g., to detect when the dispenser 101 is low on consumable product 105 such as described, for example, in WO/2018/044276, which is incorporated by reference regarding the first and second sensors). More generally, the dispenser event sensor 117 is a sensor that monitors an operational characteristic or function of the dispenser 101.

With respect to both the first impact sensor 116 and the dispenser even sensor 117 when it too is an impact sensor, in some implementations, these sensors can be calibrated (e.g., through empirical experimentation on a per-dispenser basis) so that normal operation of the dispenser 101 does not trigger an alert and that only abnormal or unwanted events trigger an alert. In other implementations, the sensors 116, 117 may send all data sensed to the data processing device 118 and the data processing device 118 can be calibrated to identify abnormal reading from the sensors 116, 117 (e.g., an abnormal reading would be one above a user-defined threshold).

As described above the dispensing system 100 (or dispenser 101) includes a data processing device 118, to store impact data describing the first impact (from the first impact sensor 116) and operational status data describing the operational status (from the dispenser event sensor 117) and associate the first impact data and the operational status data. As such, the data processing device 118 is in data communication with the sensors 116, 117 to gather readings from the sensors 116, 117 and store and/or communicate those readings. The data processing device 118 can be integral to and resident at the dispenser 101 or remote and separate from the dispenser 101 (e.g., in which case the data processing device 118 and the dispenser 101 could communicate through transceivers or transmitters and/or receivers).

In general the data processing device 118 associates first impact data and the operational status data by correlating the data, for example, by time of occurrence of the events (e.g., impacts and/or malfunctions of abnormal conditions) described by the data from the sensors 116, 117, at through other user-defined relationships.

As described above, in some implementations, the dispenser event sensor 117 is an impact sensor such as an accelerometer or velocity sensor placed on a consumable product holder 106 (e.g., roll holder 106 for a rolled paper hand towel 105) with the first impact sensor 116 being placed on the interior portion of the back side 137 of the dispenser 101. In this configuration, in response to an impact being detected (e.g., by me first impact sensor 116), the data processing device 118 compares a time of the first impact as detected by me first impact sensor 116 with a time of a second impact as detected by the second impact sensor 117 to determine which of the first impact and second impact occurred first in time.

Based on this information from the data processing device 118 (e.g., which can be sent to a smart phone or a server 150 for display via a GUI), a service technician can infer a root cause of a problem or malfunction associated with an impact to the dispenser 101. For example, if the data processing device 118 determines that the second impact occurred before the first impact (but within a user-defined time range such as 1 second or 0.5 seconds or 0.1 seconds), this may be indicative of the consumable product (e.g., roll 105) falling from the consumable product holder 106 (e.g., roll holder 106), in which case the second impact sensor 117 mounted proximate or on the holder 106 would first detect movement, with vibrations from such movement traveling through the dispenser 101 and eventually reaching the further-away, body-mounted first impact dispenser 116. Given that the holder 106 malfunction was not predicated by an external impact (as would be the case if the first impact sensor 116 recorded an impact before the second impact sensor 117) the service technician may decide to bring a new holder 106 on the service call to fix the dispenser 101, which expedites the servicing of the dispenser 101—as the technician would not have to make a second trip back to the dispenser 101 upon noticing during the first trip that the holder 106 malfunctioned.

To facilitate this expedited service process, in some implementations, the data processing device 118, in response to determining the second impact occurred before the first impact, generates a message including the associated impact and event data (e.g., indicating a malfunction of the consumable product holder). Further, to prevent the dispenser 101 from further malfunctioning given the inference that the roll 105 is no longer on the holder 106, the data processing device 118 can (e.g., based on an administrator-defined instruction set) prevent the dispensing mechanism 110 from causing consumable product to be dispensed which could further damage the dispenser 101.

Conversely, it the first impact occurred before the second impact that might suggest that the malfunction was caused by an external factor, such as a washroom occupant running into the dispenser 101. This information would inform the service technician that the dispenser 101 did not fail from an inherent design or operational flaw but rather from an anomalous event such that no further troubleshooting is required, which saves time and resources that would otherwise be required to do so.

More generally, this process can be be described as comparing a time of the first impact as detected by the first impact sensor 116 with a time of a malfunction as detected by the dispenser event sensor 117 (impact sensor or otherwise) to determine whether the malfunction occurred after the first impact. For example, if the dispenser event sensor 117 is a motor current sensor 117 and it detects an overcurrent situation, indicative of a consumable product dispense jam/malfunction, a service technician may need to diagnose the dispenser 101 to understand the root cause for the jam. However, if the first impact sensor 116 indicated a major impact just prior to the jam then that information would inform the technician's service call and reduce the time and expense associated with the service as the technician could first investigate whether the impact caused the jam as opposed to a problem with the motor or other dispensing mechanism 110 components. This information could also be used to determine if the dispenser 101 is eligible to be fixed under warranty from a design flaw or not subject to the warranty because the dispenser 101 was vandalized or otherwise misused.

In some implementations, the data from the first impact sensor 116 alone is sufficient to inform the service needs or malfunction diagnosis of a dispenser 101. More particularly, in response to the data processing device 118 determining an unusual impact occurred (e.g., an impact above a use-defined threshold) based on data from the first impact sensor 116, the data processing device 118 sends a message (e.g., according to an administrator-defined instruction set) to a service technician or server 150 reporting the impact. For example, a wirelessly-enabled dispenser 101 may send report check-in messages to a central server 150 according to a pre-determined check in interval (e.g., 12 hours). If the dispenser 101 fails to check-in for three consecutive intervals, the central sever 150 or administrator may identify the dispenser 101 as needing service, as the check-in failure could be indicative of, for example, the dispenser's batteries running out. Thus it would be beneficial to know if any catastrophic activity (e.g., abnormal impact) occurred to the dispenser 101 leading up to the check-in failure that could explain the failure.

Given that the sensor 116 is sensing movement and vibrations, in some implementations, the dispenser 101 includes an isolator coupled to the body 104, between the dispenser 101 and the surface to which the dispenser 101 is mounted, to provide vibration isolation between the dispenser 101 and the mounting surface, as it would be desirable to isolate building vibrations from causing false alarms through the sensor 116. The Isolator can be, for example, a rubber pad or spring device that reduces or eliminates extraneous vibrations (e.g., vibrations not emanating from the dispenses 101) from reaching the dispenser 101 and altering the readings/measurements from the sensor 116.

In many cases, a dispenser 101 may already be installed and not have the capability to determine impact events. In these scenarios a first impact sensor 116 can be added to these already installed dispensers to enable this capability, e.g., along with a transmitter or transceiver to send the impact data to, for example, the data processing device 118. For example, this can range from adhering or attaching (e.g., through mechanical means such as screws or nuts and bolts) the sensor 116 to the dispenser at a specific location, e.g., based on the type of dispenser 101 and the selected relationship between the sensing device location and product 105 type. Once installed, the sensor 116 can detect impacts based on measurements (or changes) of vibrations or movement of the dispenser 101.

EMBODIMENTS

Embodiment 1. A dispensing system for dispensing consumable product comprising a dispenser including a body comprising a front side and a back side, and a product holding area defined by the front side and the back side, wherein the product storage area is configured to store the consumable product within the dispenser; a dispensing mechanism operatively coupled to the consumable product through a consumable product holder in the product storage area, and wherein the dispensing mechanism is configured to facilitate a dispensing cycle to dispense a portion of the consumable product; a first impact sensor configured to sense a first impact to the dispenser; a dispenser event sensor configured to sense an operational status of the dispenser; and a data processing device configured to store impact data describing the first impact and operational status data describing the operational status and associate the first impact data and the operational status data.

Embodiment 2. The dispensing system of embodiment 1, wherein the first impact sensor comprises an accelerometer.

Embodiment 3. The dispensing system of embodiment 1, wherein the first impact sensor comprises a velocity sensor.

Embodiment 4. The dispensing system of any of the previous embodiments, wherein the dispenser event sensor comprises a motor overcurrent sensor.

Embodiment 5. The dispensing system of any of embodiments 1-3, wherein the dispenser event sensor comprises a second impact sensor.

Embodiment 6. The dispensing system of embodiment 5, wherein the second impact sensor comprises an accelerometer.

Embodiment 7. The dispensing system of embodiment 6, wherein associate the first impact data and the operational status data comprises comparing a time of the first impact as detected by the first impact sensor with a time of a second impact as detected by the second impact sensor to determine which of the first impact and second impact occurred first in time.

Embodiment 8. The dispensing system of embodiment 7, in response to determining the second impact occurred before the first impact, generating a message indicating a malfunction of the consumable product holder.

Embodiment 9. The dispensing system of embodiment 8, in response to determining the second impact occurred before the first impact, the data processing device prevents the dispensing mechanist from dispensing consumable product.

Embodiment 10. The dispensing system of embodiments 1-6, wherein associate the first impact data and the operational status data comprises comparing a time of the first impact as detected by the first impact sensor with a time of a malfunction as detected by the dispenser event sensor to determine whether the malfunction occurred after the first impact.

Embodiment 11. The dispensing system of embodiment 10, in response to determining the malfunction occurred after the first impact, the data processing device prevents the dispensing mechanism from dispensing consumable product.

Embodiment 12. The dispensing system of any of embodiments 1-3 and 10-11, wherein the dispenser event sensor comprises a low product sensor.

Embodiment 13. The dispensing system of any of embodiments 1-3 and 10-11, wherein associate the impact data and the operational status data comprises associating the impact data and the operational status data within a specified time frame.

Embodiment 14. The dispensing system of any of embodiments 1-3, wherein associate the impact data and the operational status data comprises associating the impact data and the operational status data with a next-in-time dispensing cycle.

Embodiment 15. The dispensing system of any of embodiments 1-3, wherein the operational status is one of a paper jam, low paper or low battery condition.

Embodiment 16. A method comprising detecting a first impact, by a first impact sensor, to a dispenser; during a next dispense cycle of the dispenser subsequent the first impact, detecting a malfunction, by a dispenser event sensor; and in response to detecting the malfunction, sending a malfunction alert.

Embodiment 17. The method of embodiment 16 comprising in response to detecting the malfunction, disabling the dispenser.

Embodiment 18. The method of embodiment 16, wherein detecting the malfunction comprises detecting a paper jam.

Embodiment 19. The method of any of embodiments 16 or 17, wherein detecting the malfunction comprises detecting a low or high motor current draw.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or mote computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus.

A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices). The operations described in this specification can be implemented as operations performed by a data processing apparatus on data stored on one or more computer-readable storage devices or received from other sources.

The term "data processing device" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor win receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

Implementations of the subject matter described in this specification can be implemented in a computing system that includes a back-end component, e.g., as a data serve, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a user computer (e.g., for purposes of displaying data to and receiving user input from a user interacting with the user computer). Data generated at the user computer (e.g., a result of the user interaction) can be received from the user computer at the server.

While this specification contains many specific implementation details, these should no be construed as limitations on the scope of any inventions or of what may be claimed, but rather as descriptions of features specific to particular embodiments of particular invented. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operates be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

This written description does not limit the invention to the precise terms set forth. Thus, while the invention has been described in detail with reference to the examples set forth above, those of ordinary skill in the art may affect alterations, modifications and variations to the examples without departing from the scope of the invention.

What is claimed is:

1. A dispensing system for dispensing consumable product comprising:

a dispenser including:

a body comprising a front side and a back side, and a product holding area defined by the front side and the back side, wherein the product holding area is configured to store the consumable product within the dispenser;

a dispensing mechanism operatively coupled to the consumable product through a consumable product holder in the product storage area, and wherein the dispensing mechanism is configured to facilitate a dispensing cycle to dispense a portion of the consumable product;

a first impact sensor configured to sense a first impact to the dispenser;

a dispenser event sensor configured to sense an operational status of the dispenser; and a data processing device configured to store impact data describing the first impact and operational status data describing the operational status and associate the first impact data and the operational status data, and wherein associate the first impact data and the operational status data comprises comparing a time of the first impact as detected by the first impact sensor with a time of a malfunction as detected by the dispenser event sensor to determine whether the malfunction occurred after the first impact.

2. The dispensing system of claim 1, wherein the dispenser event sensor comprises a motor overcurrent sensor.

3. The dispensing system of claim 1, wherein the dispenser event sensor comprises a second impact sensor.

4. The dispensing system of claim 3, wherein the second impact sensor comprises an accelerometer.

5. The dispensing system of claim 1, in response to determining the malfunction occurred after the first impact, the data processing device prevents the dispensing mechanism from dispensing consumable product.

6. The dispensing system of claim 1, wherein associate the impact data and the operational status data comprises associating the impact data and the operational status data within a specified time frame.

7. The dispensing system of claim 1, wherein the operational status is one of a paper jam, low paper or low battery condition.

8. A dispensing system for dispensing consumable product comprising:

a dispenser including:

a body comprising a front side and a back side, and a product holding area defined by the front side and the back side, wherein the product holding area is configured to store the consumable product within the dispenser;

a dispensing mechanism operatively coupled to the consumable product through a consumable product holder in the product storage area, and wherein the dispensing mechanism is configured to facilitate a dispensing cycle to dispense a portion of the consumable product;

a first impact sensor configured to sense a first impact to the dispenser;

a dispenser event sensor configured to sense an operational status of the dispenser; and a data processing device configured to store impact data describing the first impact and operational status data describing the operational status and associate the first impact data and the operational status data, wherein the first impact sensor comprises an accelerometer.

9. A dispensing system for dispensing consumable product comprising:

a dispenser including:

a body comprising a front side and a back side, and a product holding area defined by the front side and the back side, wherein the product holding area is configured to store the consumable product within the dispenser;

a dispensing mechanism operatively coupled to the consumable product through a consumable product holder in the product storage area, and wherein the dispensing mechanism is configured to facilitate a dispensing cycle to dispense a portion of the consumable product;

a first impact sensor configured to sense a first impact to the dispenser;

a dispenser event sensor configured to sense an operational status of the dispenser; and a data processing device configured to store impact data describing the first impact and operational status data describing the operational status and associate the first impact data and the operational status data, wherein the first impact sensor comprises a velocity sensor.

10. A dispensing system for dispensing consumable product comprising:

a dispenser including:

a body comprising a front side and a back side, and a product holding area defined by the front side and the back side, wherein the product holding area is configured to store the consumable product within the dispenser;

a dispensing mechanism operatively coupled to the consumable product through a consumable product holder in the product storage area, and wherein the dispensing mechanism is configured to facilitate a dispensing cycle to dispense a portion of the consumable product;

a first impact sensor configured to sense a first impact to the dispenser;

a dispenser event sensor configured to sense an operational status of the dispenser; and a data processing device configured to store impact data describing the first impact and operational status data describing the operational status and associate the first impact data and the operational status data, wherein associate the first impact data and the operational status data comprises comparing a time of the first impact as detected by the first impact sensor with a time of a second impact as detected by the second impact sensor to determine which of the first impact and second impact occurred first in time.

11. The dispensing system of claim 10, in response to determining the second impact occurred before the first impact, generating a message indicating a malfunction of the consumable product holder.

12. The dispensing system of claim 11, in response to determining the second impact occurred before the first impact, the data processing device prevents the dispensing mechanism from dispensing consumable product.

* * * * *